US005938070A

United States Patent [19]

Welborn et al.

[11] Patent Number: 5,938,070

[45] Date of Patent: Aug. 17, 1999

[54] SELF-ADHESIVE STAMP DISPENSER

[75] Inventors: Woodrow W. Welborn; David J. Buck, both of Laurel, Miss.

[73] Assignee: Woodrow W. Welborn, Laurel, Mich.

[21] Appl. No.: 08/966,382

[22] Filed: Nov. 7, 1997

[51] Int. Cl.[6] ..... B65H 5/28

[52] U.S. Cl. ..... 221/73; 221/71

[58] Field of Search ..... 221/70, 71, 72, 221/73; 156/584

[56] References Cited

U.S. PATENT DOCUMENTS

| | | | |
|---|---|---|---|
| 2,276,297 | 3/1942 | Flood | 221/73 X |
| 4,853,074 | 8/1989 | Manusch et al. | 156/584 X |
| 4,954,210 | 9/1990 | Desmond | 221/73 X |
| 5,005,730 | 4/1991 | Pickrell, Jr. et al. | 221/71 |
| 5,770,007 | 6/1998 | Czech et al. | 156/584 X |

*Primary Examiner*—William E. Terrell
*Assistant Examiner*—Patrick Mackey
*Attorney, Agent, or Firm*—Edwin E. Greigg; Ronald E. Greigg

[57] ABSTRACT

A product dispenser which comprises a somewhat rectangular housing having front and rear walls, integral with a side wall, a top wall portion and a bottom wall portion and a removable side wall. The top wall is provided with a slot perpendicular with the side wall and the front wall has a slot therein. A product holder is fixed to the side wall in an area below the slot in the top wall. A take-up reel is secured on an axle molded to the fixed side walls below the fixed top portion. The take-up and dispenser reel includes outer flanges which extend below the side walls so that the flanges can roll on a surface below the side walls in order to take-up a backing sheet while simultaneously dispensing the product from the product holder. The removable side wall is removed to load the product in the product holder and to remove the backing sheet from the take-up reel. If there is no backing sheet, the product is fed via the slot in the top wall by hand in order to dispense the product.

3 Claims, 3 Drawing Sheets

SELF-ADHESIVE STAMP DISPENSER

BACKGROUND OF THE INVENTION

PRIOR ART

Heretofore, dispensers have been used to dispense labels, stamps, etc. These devices make use of hand rotated means, wheels and small electric motors for dispensing the elements. Some of these devices have a take-up rotor on which a backing sheet of the product dispensed is wound.

OBJECT AND SUMMARY OF THE INVENTION

This invention is directed to a dispenser which includes a rectangular or any other shaped housing in which the product is stored for dispensing. The housing includes therein means for feeding the product through a slot to be dispensed. The housing also includes therein means upon which a backing sheet can be rolled as the product is dispensed.

It is therefore an object of this invention to provide a simple constructed and operated dispenser for dispensing a product with or without a backing sheet.

Another object is to provide a dispenser which can dispense a product of different widths.

Still another object is to provide a dispenser which can be operated by a child or any other person.

Yet another object is to provide a dispenser which is easy to assemble and which is rather inexpensive.

While another object is to provide a dispenser with a take-up reel which is easy to assemble and which has a few moving parts.

OTHER OBJECTS AND ADVANTAGES

The invention will be better understood and further objects and advantages thereof will become more apparent from the ensuing detailed description of preferred embodiments taken in conjunction with the drawings.

DETAILED DESCRIPTION OF THE DRAWINGS

Figure 1:
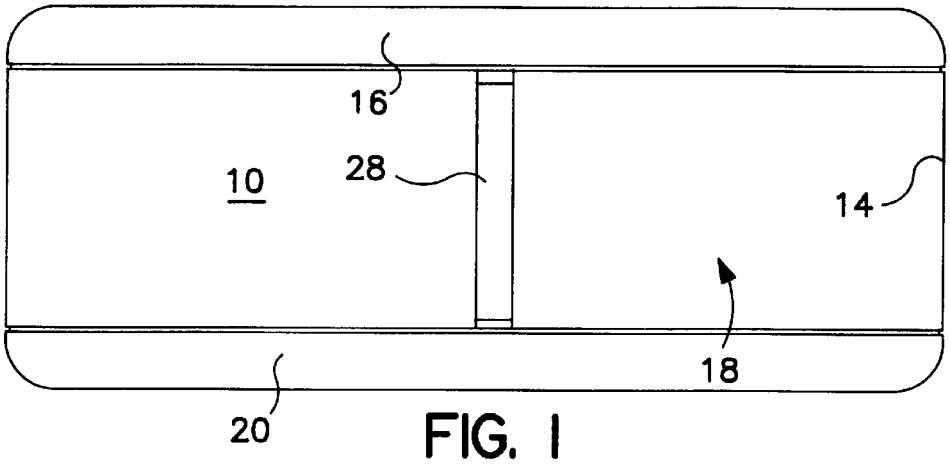
FIG. 1 illustrates a top view of the device illustrating a slot through which a product is dispensed.

Now referring to the drawings there is shown a dispenser which includes a somewhat rectangular housing 10 made of a plastic mold or any other similar material and shape having front and back ends 12, 14, integral with a side 16 and a top portion 18 with the housing mostly enclosed by a bottom 21 of the housing. The opposite side 20 is removable to expose the inner parts. The front end is provided with a rounded upper portion 22 which is provided with a slot 24 through which a backing sheet 19 of a roll of self-adhesive stamps 23 can be fed and which is wound on a take-up roller 26 to be described later. The back end 14 extends upwardly so that the upper end is rounded to continue as the top portion 22 in one piece. The top portion, side 16, ends 12 and 14 and the bottom portion are formed by a single mold of plastic material and the top is cut along its width perpendicular to the sides and at an angle which slopes downwardly toward the back end to form a slot 28 through which the (self-adhesive stamps) is fed from a roll secured in a product holder 30. The product holder is provided with a tension lever 32 which applies a tension on the product as the product is dispensed. The product holder 30 is molded along with the housing and is integrally attached to the side 16 and the bottom 21 of the housing. The product holder has a cylindrical shape formed below the slot 28 in the top portion and cut away across its width to provide an opening 34 through which one end of the product is placed for dispensing the product. The product holder is fixed in front of a partition 36 which extends across the width of the housing and the tension lever is rotatably secured at one end in a semi-circular holder 38 integral with the product holder 30. The tension holder has a curved end 40 which rests against the partition 36 to apply a tension on the product as the product is dispensed from the product holder. The ends of the product holder is provided with the perpendicular cross pieces 42 for added strength of the product holder.

In the area of the housing in front of the product dispenser an axle 44 is integrally secured with the side 16 of the housing and which has another end supported by the side 20. The axle 44 supports the take-up roller or reel 26 for rotation about the axle in order to take-up the backing sheet and simultaneously dispenses the product as the roller is rotated. The roller is provided with a slot 45 into which the loose end of the backing sheet is secured. The take-up roller or reel is rotatable about the axle 44 in which the ends of the axle are supported by the sides of the housing. The take-up roller or reel has outer-opposite side flanges 46 which prevent the backing sheet from moving off the ends of the roller when the backing sheet is rolled onto the roller. The opposite side flanges extend down below the side walls of the housing so that the take-up reel can be rotated by aide of the flanges. In order to make the rotation of the reel easier, rubber rings 49 can be assembled onto the flanges. Thus, the rubber surface will have a better grip on the surface for rotating the reel.

The side 20 of the housing is removable so that the dispenser can be loaded with the product to be dispensed and if there is a backing sheet the loose end of the backing sheet is secured in the slot 45 in the roller so that the backing sheet is rolled onto the roller as the roller is rotated to dispense the product. The product is dispensed by the backing sheet being rolled onto the roller as the roller is rotated on a surface or by hand. If there is no backing sheet, the product is dispensed by hand by pulling the product through the slot 28.

Since the cylindrical product holder is integral with the bottom 21 and the side 16 and the take-up reel is secured to the side wall 16, the side 20 is removable in order to load the product and to secure the end of the backing sheet to the take-up reel. The side 20 is provided with a latch on the bottom surface, not shown, which is secured in place by a latch holder 50 molded on the bottom enclosure.

In assembly and operation of the dispenser, the dispenser is molded with the ends, sides, top and bottom portion with the product holder integral with the bottom portion and the fixed side, with the axle for the take-up reel fixed to the side 16 and the latch 50 is also formed. The movable side 20 is molded separately for securing to the housing part. The removable side is provided with a top latch means and a bottom latch means that is secured to the top and bottom portions of the housing. The side is removable for the purpose of loading the dispenser and for removing the backing sheet rolled onto the roller. With the removable side removed, the product is placed in the product holder and the loose end of the product is pulled out through the slot 28 along the fixed top portion. The loose end of the backing sheet is then fed through the slot 24 in the front wall and wound onto the reel or fixed to the reel by a tape or other means so that the backing sheet will be secured to the take-up reel. Once the product has been placed in the product holder and the backing sheet secured to the take-up reel, the removable side is secured in place by the latch means. In order to dispense the product the take-up reel must extend below the bottom surface and rotated on a surface or by hand so that the take-up reel pulls the backing sheet and winds the backing sheet onto the take-up reel. As the backing sheet is wound onto the take-up reel the product to be dispensed is pulled from the product holder and exposed above the fixed top portion so that the product can be removed from the backing sheet. Once all of the product has been dispensed, the removable side is removed, then the backing sheet can be removed from the take-up reel and another roll of the product to be dispensed can be added to the product holder to repeat the above operation. It is to be noted that as the backing sheet is wound onto the take-up and dispensing reel that rotation of the take-up and dispensing reel pulls the product to be dispensed from the product holder so that the product to be dispensed can be removed from the backing sheet.

The foregoing relates to preferred exemplary embodiments the invention, it being understood that other variants and embodiments thereof are possible within the spirit and scope of the invention, the latter being defined by the appended claims.

The invention claimed and desired to be secured by Letters Patent of the United States is:

1. A self-adhesive stamp dispenser comprising a housing;

said housing including front and back ends (12, 14), a first side portion (16), a top portion (18), and a bottom portion (21); said front and back ends, said first side portion, said top portion and said bottom portion are integral with each other and in combination with a second side portion (20) which is detachably secured by securing means to said front and back ends, said top portion and said bottom portion to form said housing;

a product holder (30) secured within said housing for retaining a product to be dispensed;

a take-up reel in said housing;

an axle secured in said housing for supporting said take-up reel within said housing for rotation of said take-up reel thereon;

said top portion includes an angular slit (28) which slopes downwardly and toward said back end through which an end of the product to be dispensed is threaded from said product holder along a portion of said top portion toward said front end;

a slot (24) is provided in said front end of said housing through which a backing sheet of said product is fed in order to secure a loose end of said backing sheet onto said take-up reel in said housing;

said take-up reel has a portion that extends below said bottom portion via an opening in said bottom portion, whereby said take-up reel is rotated for dispensing said product and for winding said backing sheet onto said take-up reel, said housing includes a partition (36) spaced from said back end and spaced from said product holder (30), and a tension lever having one end pivotally secured onto said product holder for rotation relative to said product holder, and a portion of said tension lever is supported by said partition whereby said tension lever applies a tension on stamps as the stamps are dispensed from said product holder.

2. A self-adhesive stamp dispenser as set forth in claim 1, in which said take-up reel is provided with side flanges (46) which prevent the backing sheet from moving off the roller; and said side flanges extend below said bottom portion so that the take-up reel can be rotated by aide of said side flanges.

3. A self-adhesive stamp dispenser as set forth in claim 1, in which said product holder (30) and said axle are each secured at one end to an inner surface of said first side portion.

* * * * *

UNITED STATES PATENT AND TRADEMARK OFFICE
CERTIFICATE OF CORRECTION

PATENT NO. : 5,938,070

DATED : August 17, 1999

INVENTOR(S) : Woodrow W. Welborn; David J. Buck

It is certified that error appears in the above-identified patent and that said Letters Patent is hereby corrected as shown below:

On the Title page, correct Assignee's address:

[73] Assignee: Woodrow W. Welborn, Laurel, Miss.

The illustrative figure on the Title page should be deleted and a corrected Title page substituted therefor.

Figure 2:
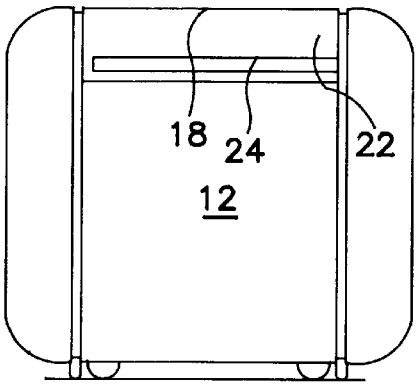
FIG. 2 is a front view illustrating a slot through which a backing sheet can pass to a take-up reel.
Figure 3:
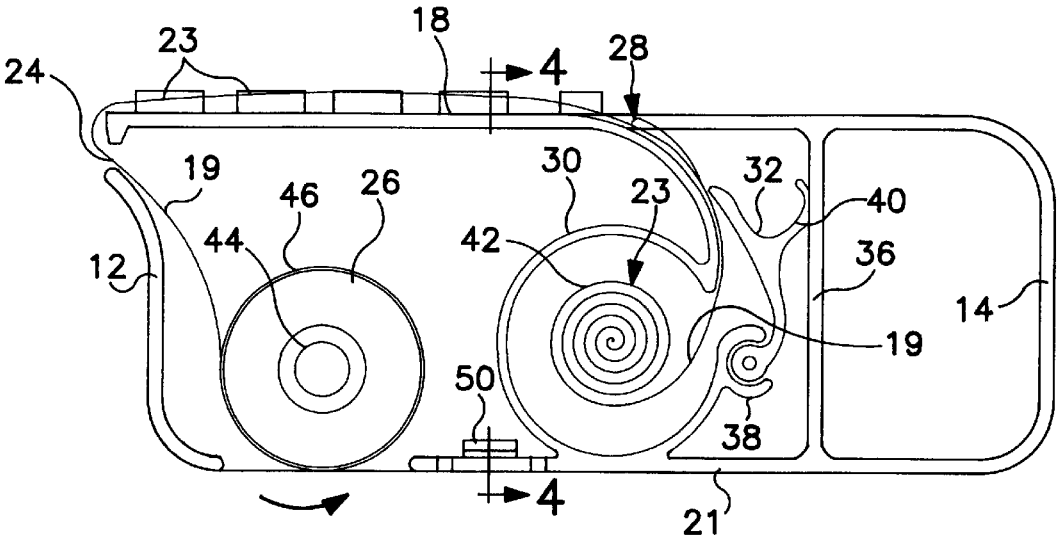
FIG. 3 illustrates a side view with a side removed to illustrate the inner parts.
Figure 4:
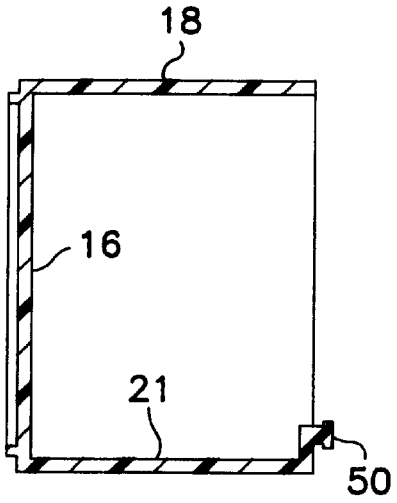
FIG. 4 is a cross sectional view of the body shown in FIG. 3 without the removed sides.
Figure 5:
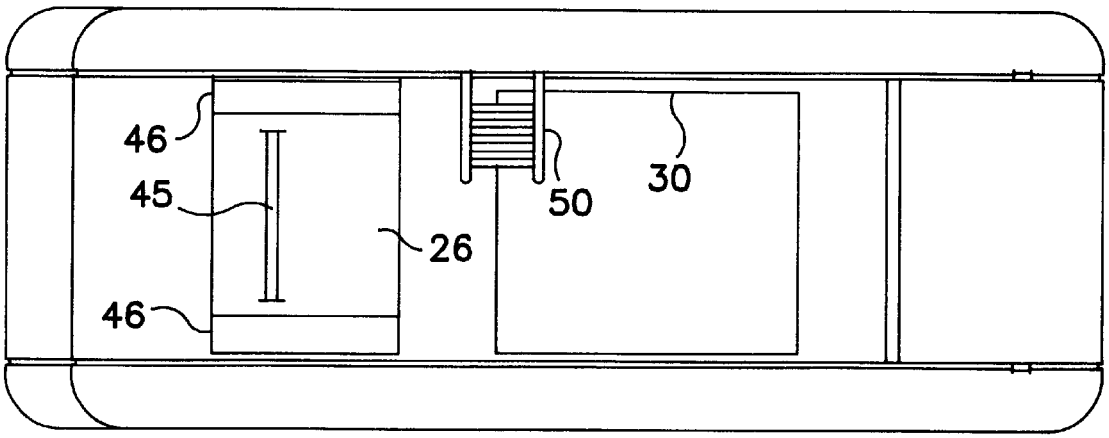
FIG. 5 illustrates a bottom view looking toward the inner parts.
Figure 6:
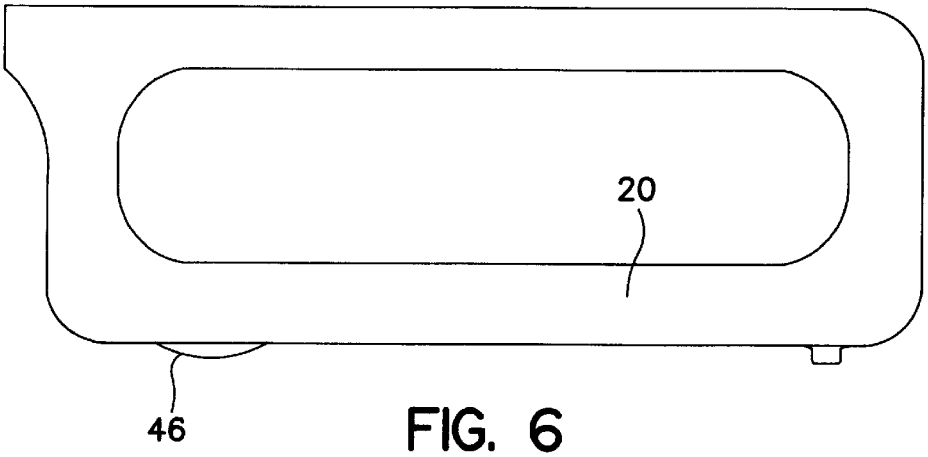
FIG. 6 illustrates a side view looking toward the side enclosure.
Figure 7:
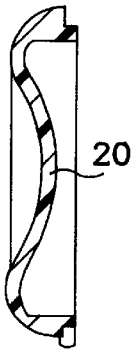
FIGS. 7 and 8 illustrate a cross section through the side panel, near opposite ends.
Figure 8:
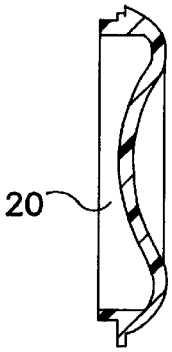
Figure 9:
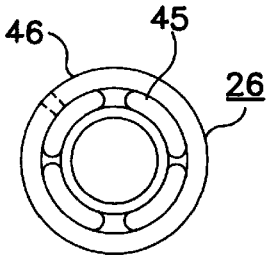
FIG. 9 illustrates an end view of the backing sheet reel.
Figure 10:
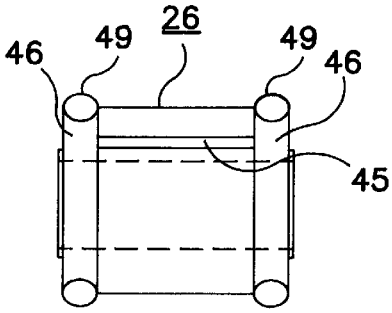
FIG. 10 illustrates a front view of the reel.
Figure 11:
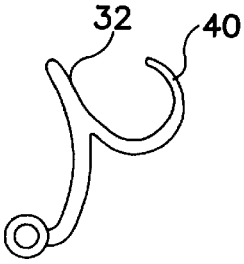
FIG. 11 illustrates a tension lever which applies a holding pressure on the product as it is fed from the product holder.
Figure 12:
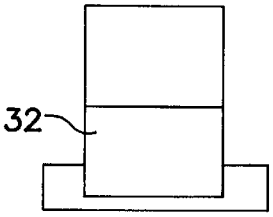
FIG. 12 illustrates a width of the tension lever.

Drawings:

Delete drawing sheets 1-5 and substitute therefor the drawing sheets consisting of Figs. 1-5 as shown on the attached pages.

Signed and Sealed this

Twenty-third Day of May, 2000

*Attest:*

Q. TODD DICKINSON

*Attesting Officer*

*Director of Patents and Trademarks*

United States Patent [19]

Welborn et al.

[11] Patent Number: 5,938,070

[45] Date of Patent: Aug. 17, 1999

[54] SELF-ADHESIVE STAMP DISPENSER

[75] Inventors: Woodrow W. Welborn; David J. Buck, both of Laurel, Miss.

[73] Assignee: Woodrow W. Welborn, Laurel, Mich.

[21] Appl. No.: 08/966,382

[22] Filed: Nov. 7, 1997

[51] Int. Cl.[6] ..... B65H 5/28

[52] U.S. Cl. ..... 221/73; 221/71

[58] Field of Search ..... 221/70, 71, 72, 221/73; 156/584

[56] References Cited

U.S. PATENT DOCUMENTS

| | | | |
|---|---|---|---|
| 2,276,297 | 3/1942 | Flood | 221/73 X |
| 4,853,074 | 8/1989 | Manusch et al. | 156/584 X |
| 4,954,210 | 9/1990 | Desmond | 221/73 X |
| 5,005,730 | 4/1991 | Pickrell, Jr. et al. | 221/71 |
| 5,770,007 | 6/1998 | Czech et al. | 156/584 X |

*Primary Examiner*—William E. Terrell
*Assistant Examiner*—Patrick Mackey
*Attorney, Agent, or Firm*—Edwin E. Greigg; Ronald E. Greigg

[57] ABSTRACT

A product dispenser which comprises a somewhat rectangular housing having front and rear walls, integral with a side wall, a top wall portion and a bottom wall portion and a removable side wall. The top wall is provided with a slot perpendicular with the side wall and the front wall has a slot therein. A product holder is fixed to the side wall in an area below the slot in the top wall. A take-up reel is secured on an axle molded to the fixed side walls below the fixed top portion. The take-up and dispenser reel includes outer flanges which extend below the side walls so that the flanges can roll on a surface below the side walls in order to take-up a backing sheet while simultaneously dispensing the product from the product holder. The removable side wall is removed to load the product in the product holder and to remove the backing sheet from the take-up reel. If there is no backing sheet, the product is fed via the slot in the top wall by hand in order to dispense the product.

3 Claims, 3 Drawing Sheets

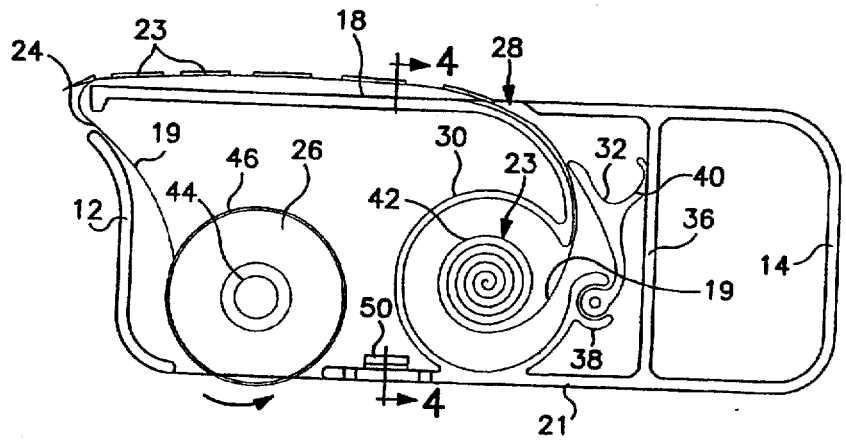

UNITED STATES PATENT AND TRADEMARK OFFICE

CERTIFICATE OF CORRECTION

PATENT NO. : 5,938,070

DATED : August 17, 1999

INVENTOR(S) : Woodrow W. Welborn; David J. Buck

It is certified that error appears in the above-identified patent and that said Letters Patent is hereby corrected as shown below:

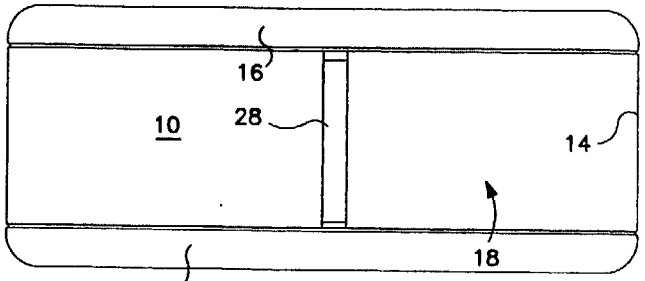

FIG. 1

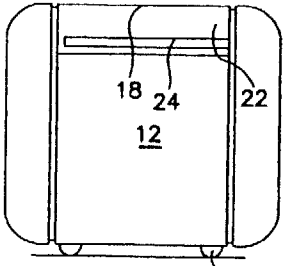

FIG. 2

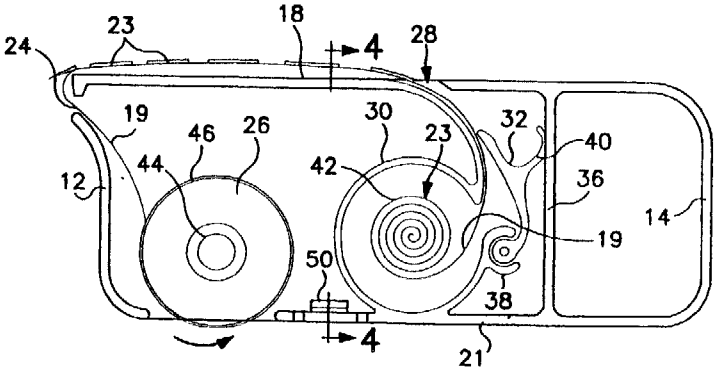

FIG. 3

UNITED STATES PATENT AND TRADEMARK OFFICE

CERTIFICATE OF CORRECTION

PATENT NO. : 5,938,070

DATED : August 17, 1999

INVENTOR(S) : Woodrow W. Welborn; David J. Buck

It is certified that error appears in the above-identified patent and that said Letters Patent is hereby corrected as shown below:

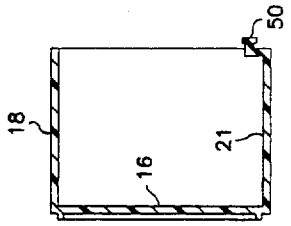

FIG. 4

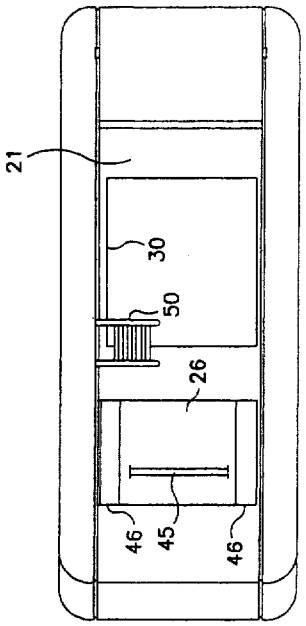

FIG. 5